United States Patent [19]

Gironi et al.

[11] Patent Number: 5,012,564

[45] Date of Patent: May 7, 1991

[54] METHOD AND APPARATUS FOR LOADING THE BOBBIN CREEL OF A WINDING INSTALLATION

[75] Inventors: Fabrizio Gironi, Prato, Italy; Jakob Iten, Oberuzwil, Switzerland; Gerhard Koslowski, Uzwil, Switzerland; Willy Probst, Gossau, Switzerland

[73] Assignee: Benninger AG, Uzwil, Switzerland

[21] Appl. No.: 427,094

[22] PCT Filed: Feb. 13, 1989

[86] PCT No.: PCT/CH89/00023

§ 371 Date: Oct. 16, 1988

§ 102(e) Date: Oct. 16, 1988

[87] PCT Pub. No.: WO89/07671

PCT Pub. Date: Aug. 24, 1989

[30] Foreign Application Priority Data

Feb. 17, 1988 [IT] Italy ..... 9331 A/88

[51] Int. Cl.[5] ..... D02H 1/00

[52] U.S. Cl. ..... 28/193

[58] Field of Search ..... 28/191, 193, 201; 242/131.1

[56] References Cited

U.S. PATENT DOCUMENTS 3,875,883 4/1975 Eberwein et al. ..... 242/131.1 X 4,783,021 11/1988 Nagasawa ..... 28/193

FOREIGN PATENT DOCUMENTS 728460 11/1942 Fed. Rep. of Germany ..... 28/193

*Primary Examiner*—Werner H. Schroeder

*Assistant Examiner*—John J. Calvert

*Attorney, Agent, or Firm*—Shoemaker and Mattare

[57] ABSTRACT

In order to make the loading operation on a bobbin creel simpler, a fitting pattern is stored for each kind of bobbin in a control means (21). The individual fitting patterns can be sequentially called up as output signals. Those output signals either activate signal elements which are associated with each mounting device (14) at the bobbin creel (3) or they serve directly for controlling an automatic loading apparatus.

17 Claims, 6 Drawing Sheets

METHOD AND APPARATUS FOR LOADING THE BOBBIN CREEL OF A WINDING INSTALLATION

The invention relates to a method and apparatus for loading the bobbin creel of a winding installation, in particular a warping installation, which has a plurality of mounting devices on to which bobbins of different kinds are to be fitted or can be fitted.

In relation to a yarn array which consists of yarns of the same kind, no problems are involved in fitting the yarn bobbins on to the mounting devices at the bobbin creel. Difficulties only arise where a yarn array consists of yarns of different colour and/or quality so that the yarn bobbins of different kinds must be fitted into position on the mounting devices at the bobbin creel in a quite specific fitting pattern. That loading operation requires a high level of attentiveness on the part of the operating personnel and a relatively large amount of time.

Accordingly an object of the invention is either substantially to simplify the operation of loading the bobbin creel from the point of view of the operating personnel so that misloadings are practically eliminated, or fully automated the loading operation.

In accordance with the invention, that object is attained with a method having the features of claim 1 and an apparatus having the features of claim 6.

In that connection the control means in practice takes over the operation of computing the entire fitting pattern or patterns in respect of the individual kinds of bobbins, which previously was to be carried out by the operating personnel. In that respect the term fitting pattern means the sequence in which the bobbins are to be mounted on the creel. The fact that the individual fitting patterns of a given kind can be sequentially called up makes it possible in a particularly simple manner to identify the individual mounting devices which have to be respectively loaded. The loading operation can be carried out manually or automatically by way of an automatic loading device. In that connection, different fitting patterns can be readily formed alternatively for the same thread array so that accordingly it is possible to provide for a straight, a skip or a double-skip infeed, for example, at the warping machine. The starting location for the loading operation on the bobbin creel is a secondary consideration, which is highly advantageous in particular in regard to manual loading.

In a particularly advantageous manner, each individual mounting device is provided with an optical display such as for example an LED. Displays of that kind take up a small amount of space, require relatively little maintenance and are easy to actuate. Thus for example the optical displays of a row of bobbins on the bobbin creel can be jointly actuable by way of a multiplexer. It would also be possible to envisage using other optical displays such as for example movable signal flags etc.

For the purposes of monitoring the loading operation, each optical display may have associated therewith an acknowledgement switch for manual acknowledgement that the operation of loading the mounting device has been performed. Alternatively however each mounting device could have a sensor device for monitoring the presence of a bobbin. In that connection the control means can be programmed in such a way that a subsequent signal sequence for the fitting pattern of a different kind of bobbin can be called up only when previously all mounting devices of a preceding fitting pattern have been loaded or if the loading thereof has been manually acknowledged.

Further advantages and individual features of the invention will be apparent from the following description of embodiments of the invention and from the drawings in which.

Figure 3:
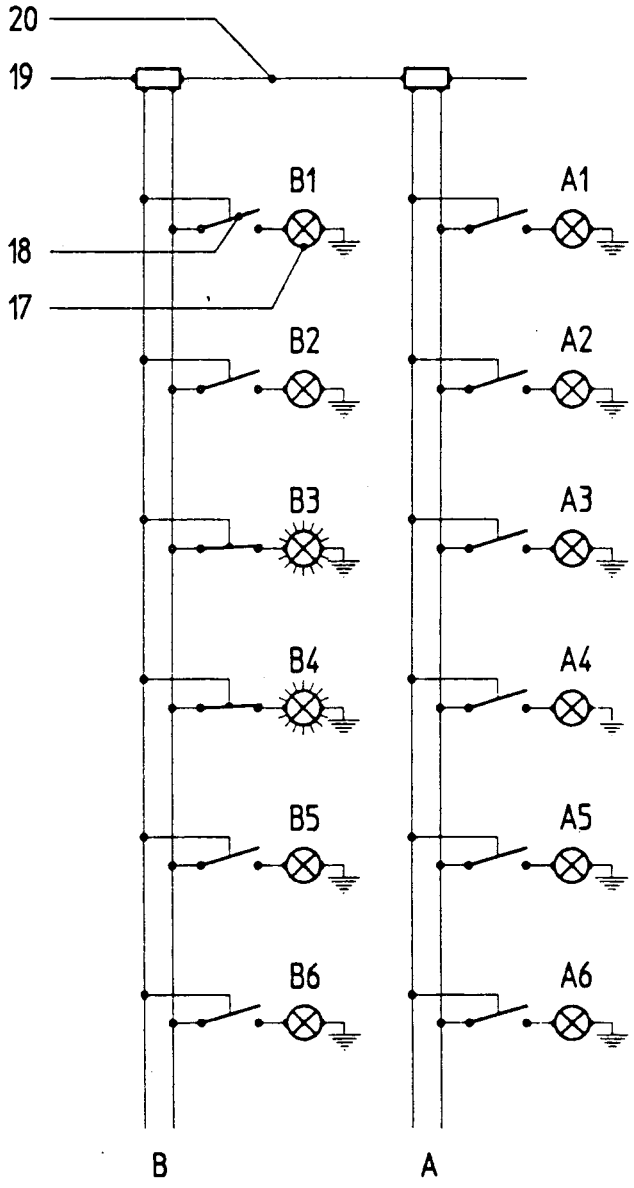
Figure 4A:
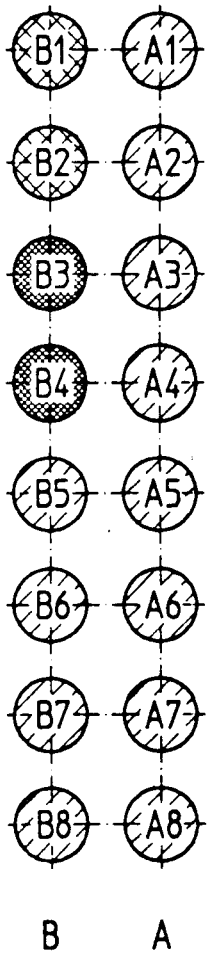
Figure 4B:
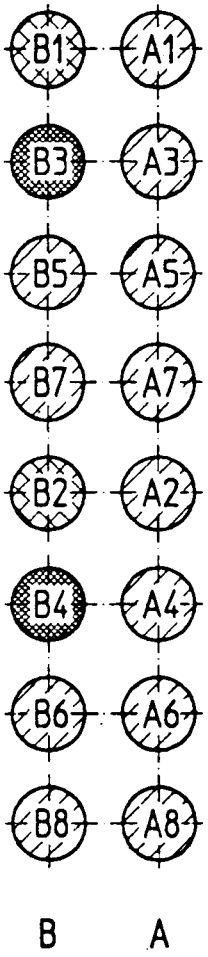
Figure 4C:
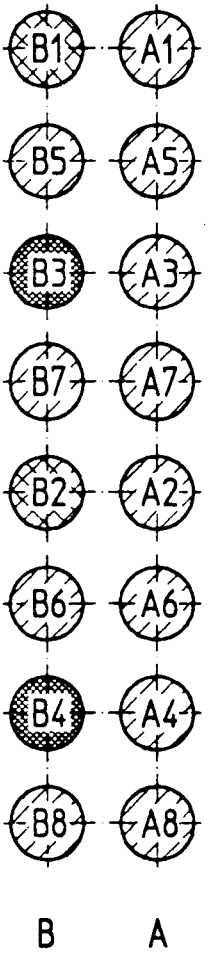
Figure 5:
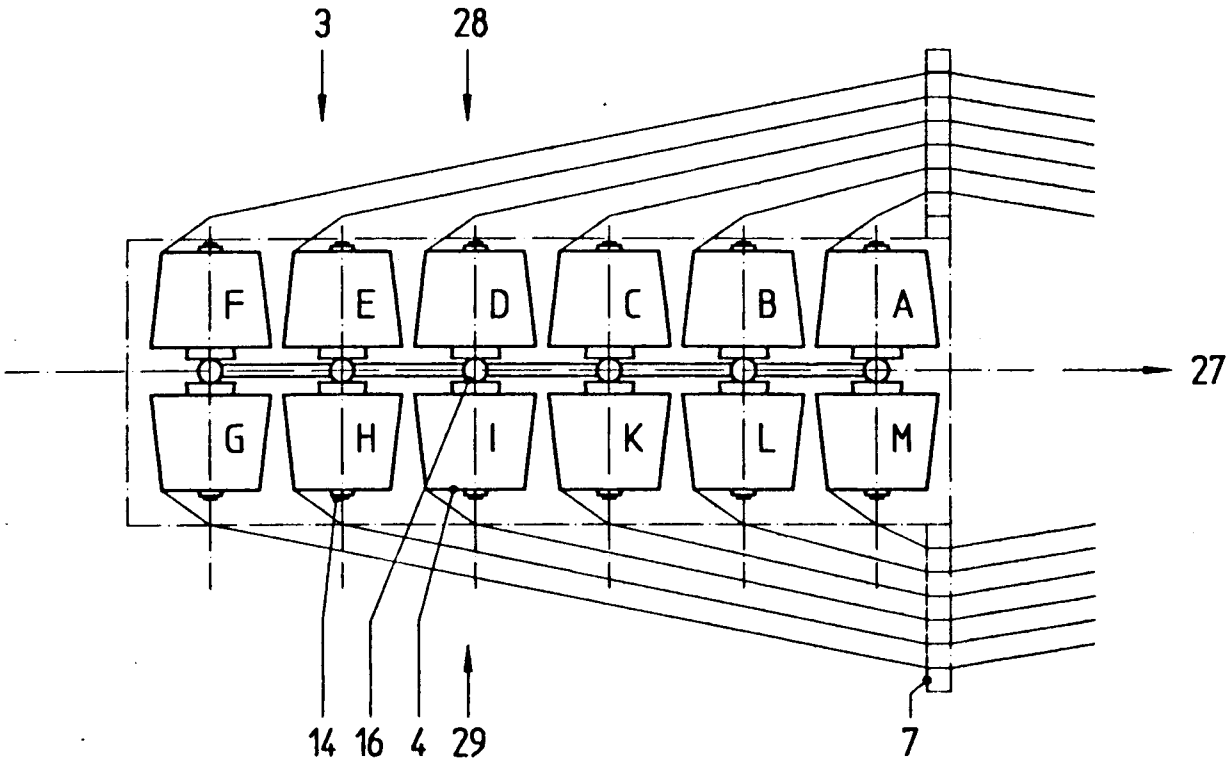
Figure 6:
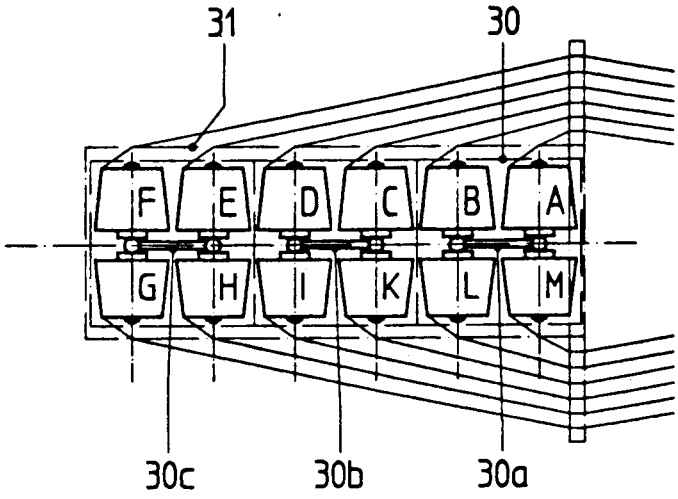
Figure 6:
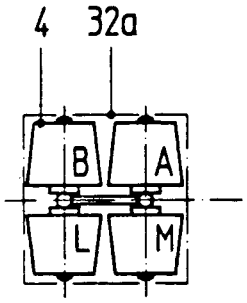
Figure 7:
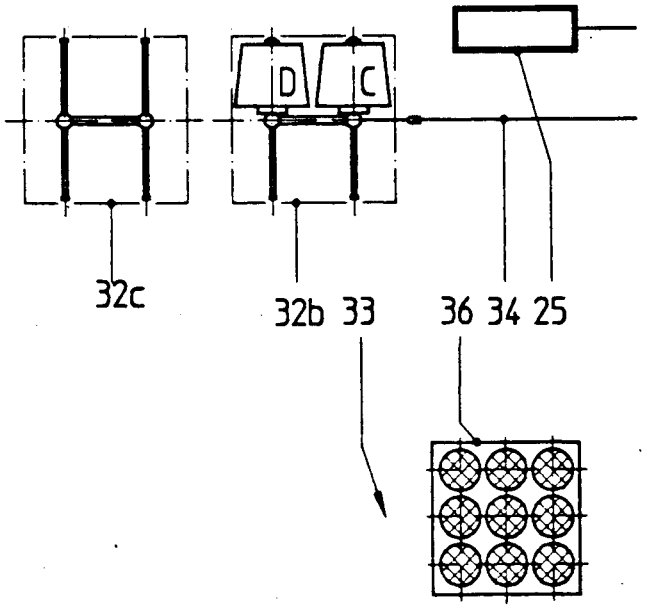
Figure 8:
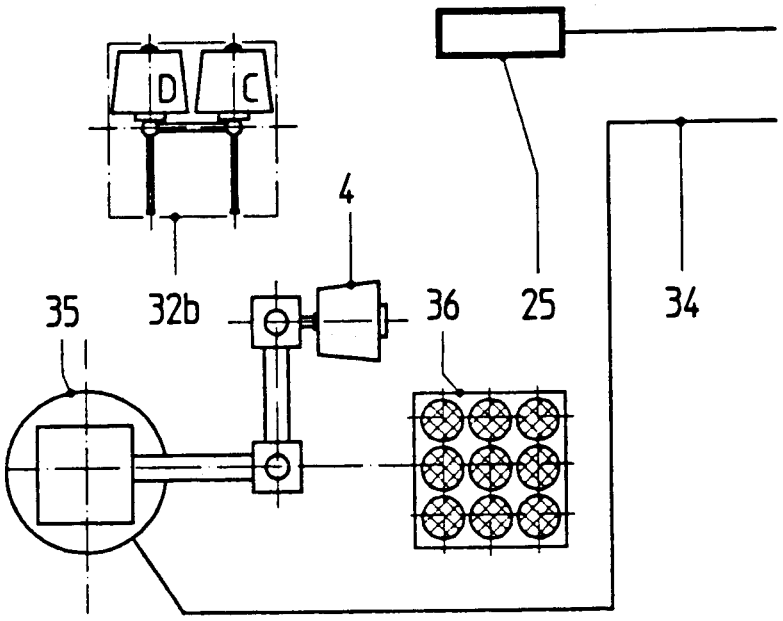
Figure 9:
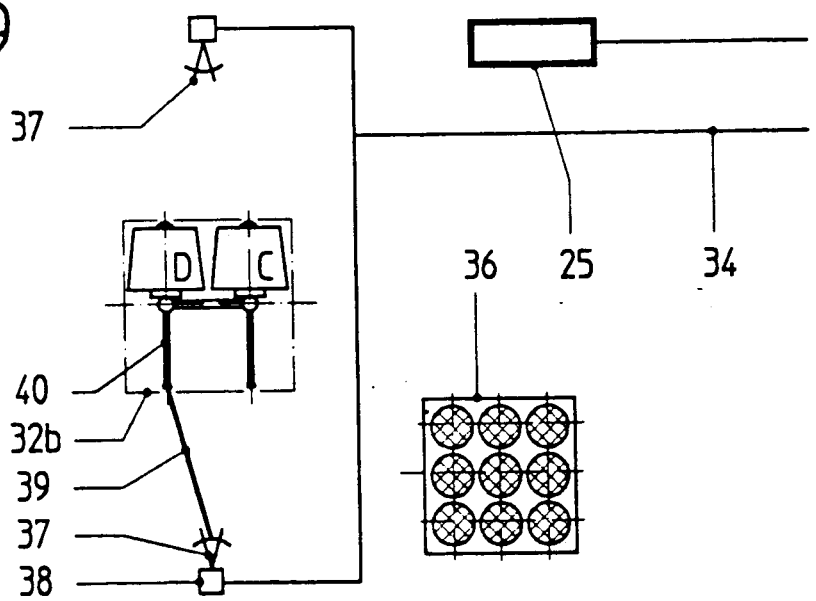

FIG. 3 shows the electrical diagram in respect of the rows of bobbins A and B in FIG. 1, FIGS. 4*a* through 4*c* show different fitting patterns for the same yarn array, FIG. 5 is a plan view of a bobbin creel, FIG. 6 is a plan view of a bobbin carriage creel, FIG. 7 shows a bobbin carriage loading station, FIG. 8 shows a bobbin carriage loading station with robot loading, and FIG. 9 shows a bobbin carriage loading station with light beam guide arrangement.

Figure 1:
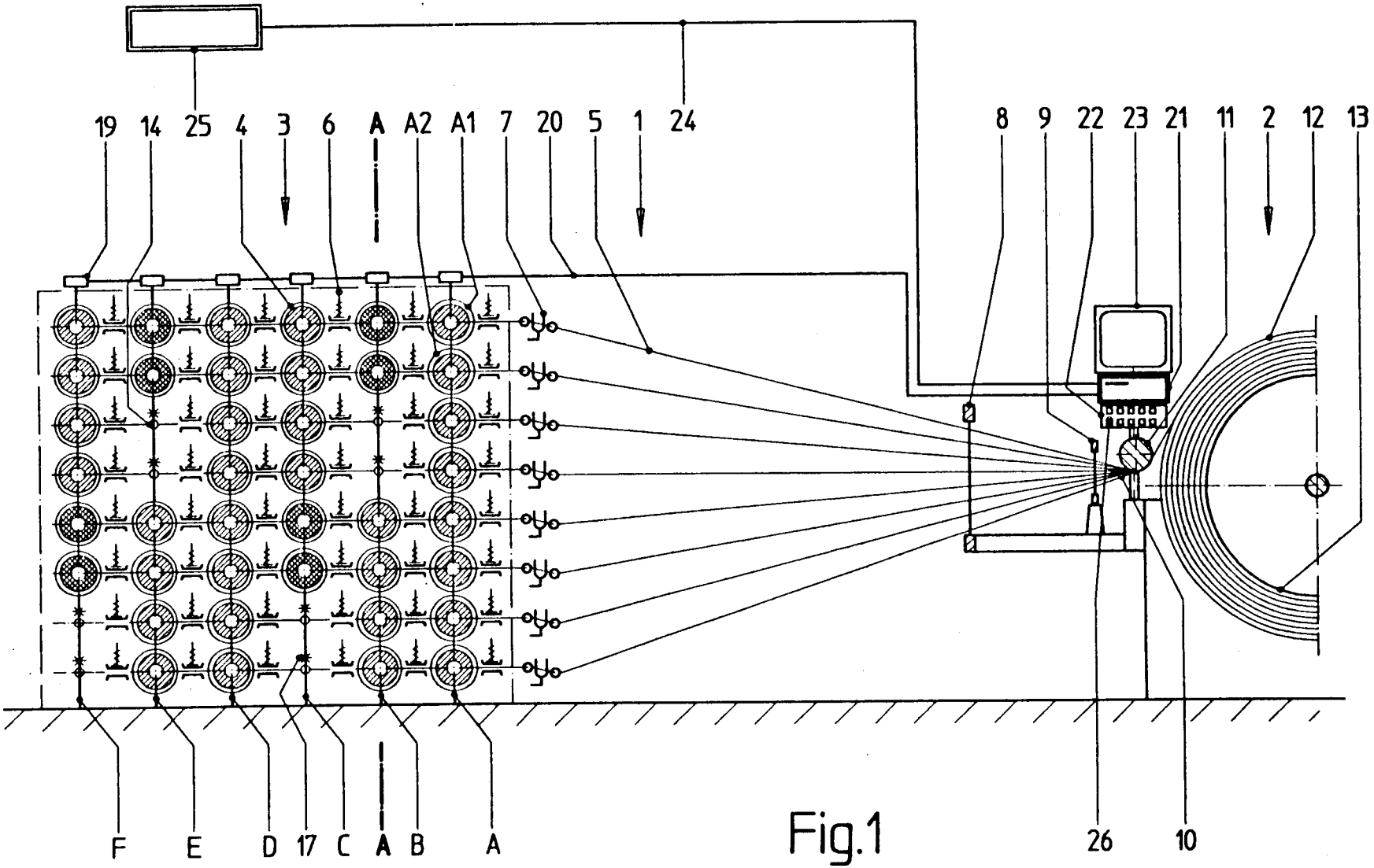
FIG. 1 is a greatly simplified side view of a warping installation.

Referring to FIG. 1, a warping installation 1 comprises the warping machine 2 and the bobbin creel 3. The bobbins 4 are mounted on the bobbin creel 3 and the drawn-off yarns 5 each pass through a respective yarn brake 6 for maintaining a predetermined, uniform yarn tension, as well as a yarn monitor 7 for monitoring for the presence of the yarns.

The yarns 5 then pass into the region of the warping machine 2 where they initially pass through a cross reed 8 in which the yarns 5 are put into their correct sequence. The yarns are then fed to the warping reed 9 in which they are brought together and in the form of a fibre array 10 are wound over a direction-changing roller 11, as a ribbon or sheet 12, on to the warping drum 13 of the warping machine 2, in known manner. The patterning configuration or repeat of the yarn array substantially determines the appropriate arrangement of the individual yarn bobbins of different kinds on the mounting devices 14 of the bobbin creel. For the purposes of identifying the fitting patterns of the individual kinds of bobbins, the mounting devices 14 are provided with signal elements 17 which for example comprise LEDs.

Figure 2:
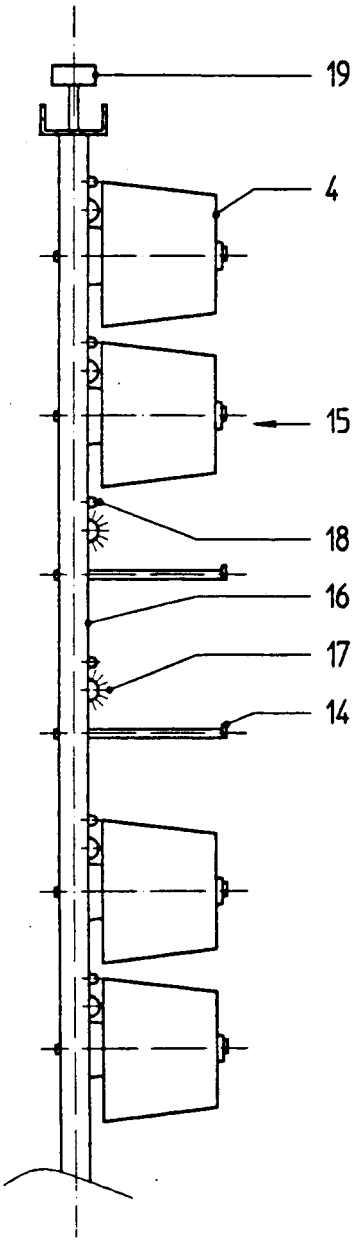
FIG. 2 shows the vertical row of bobbins in the plane A—A in FIG. 1.

FIG. 2 shows a vertical row of bobbins, as indicated at 15, comprising a bobbin carrier tube 16 with the mounting devices 14. The bobbins 4 are fitted on to the mounting devices 14. Each mounting device or each signal element 17 is also provided with an acknowledgement key or button 18 at which the fitting of a bobbin thereon can be acknowledged.

All signal elements 17 and acknowledgement keys or buttons 18 of a vertical row of bobbins 15 are combined together in a multiplexer, as shown in FIG. 3. All multiplexers 19 of the bobbin creel 3 are connected by way of a connecting line 20 to the control means 21. The control means 21 is, for example, a computer with an input station 22 and a picture screen 23.

For the following description of the fitting operation, it is assumed that the bobbin creel 3 is subdivided into vertical creel rows A through F and into stages 1 through 8. Taking the repeat of the desired yarn array as the basic starting point, for example the following sequence of bobbins is to be mounted in position:

8 bobbins white 2 bobbins yellow 2 bobbins green with that repeat being used for example four times. That would mean that the mounting devices 14 are to be loaded as follows:

A1 through A8 with white bobbins
B1 and B2 with yellow bobbins
B3 and B4 with green bobbins
B5 through B8 with white bobbins
C1 through C4 with white bobbins
C5 and C6 with yellow bobbins
C7 and C8 with green bobbins
D1 through D8 with white bobbins
E1 and E2 with yellow bobbins
E3 and E4 with green bobbins, etc.

That desired repeat is inputted into the control means 21 by way of the input station 22 and displayed on the picture screen 23. It is also possible for the computer itself to determine that repeat on the basis of a computer program and on the basis of inputted warping data, and to convert it into corresponding output signals. Those output signals can now be sequentially called up and pass by way of the connecting line 20 to the bobbin rows A through F where they activate the corresponding signal elements 17 by way of the multiplexers 19.

For the purposes of fitting the white bobbins in position, the following signal elements are firstly activated: A1 through A8, B5 through B8, C1 through C4, D1 through D8, E5 through E8 and F1 through F4. The corresponding LEDs are lit and the operator now begins to load the correspondingly identified mounting devices with white bobbins. In that connection it is immaterial whether the loading operation is begun at the top, at the bottom, on the left or on the right. So that the operator knows in which signal sequence he or she is just operating, the control means 21 can activate by way of the connecting line 24 a display panel 25 in which for example the item 'white bobbins' is lit. The display panel can be for example an LED display or another known device for displaying information.

After each individual mounting device 14 has been loaded, the associated acknowledgement key or button 18 is pressed so that the associated signal element 17 goes out. At the same time the acknowledgement is also transmitted to the control means or computer 21. It is only when the last white bobbin has been fitted on the mounting device and the acknowledgement key or button 18 thereof has been pressed that the control means 21 releases the next signal sequence for displaying the fitting pattern for the yellow bobbins. In that situation, the signal elements 17 of the following mounting devices are lit: B1 and B2, C5 and C6, E1 and E2, F5 and F6. At the same time the working instruction 'yellow bobbins' appears on the display panel 25. When that operating step has also been concluded, the same procedure is also carried out for the green bobbins.

As can be seen from FIGS. 1 through 3, the green bobbins B3 and B4, C7 and C8, E3 and E4, F7 and F8 have not yet been fitted into position and the signal elements 17 for the fitting pattern for the green bobbins are lit. 'Green bobbins' appears on the display panel 25. As soon as the last green bobbin has been fitted and all green bobbins have been acknowledged, for example the entry 'fitting operation concluded' appears on the display panel. The computer 21 now frees the warping machine for it to carry out the winding operation.

The same fitting pattern may not be selected for each working process or for each repeat. Thus, specifically for the purposes of facilitating a subsequent sizing operation, it is necessary to effect better yarn separation at the yarn array, which also requires a different fitting pattern. The yarn in-feed is therefore not always effected only in a straight mode, as shown in FIG. 1, but also in a skip or double-skip mode. Those different fitting patterns are shown in FIGS. 4*a* through 4*c*, wherein FIG. 4*a* represents a straight in-feed, FIG. 4*b* represents a skip in-feed and FIG. 4*c* represents a double-skip in-feed. Ideal results can be achieved in the sizing operation, with the double-skip mode. However the use thereof also requires a high level of attentiveness and care on the part of the operator, when using conventional fitting methods.

The input station 22 or the control means 21 is provided with a selector switch 26 for the in-feed mode, at which the desired mode, straight, skip or double-skip, can be selectively set. The signal elements 17 are activated in a different fitting pattern, in accordance with the selected mode of operation.

As can be seen from the plan view in FIG. 5, the bobbin creel is loaded on both sides. Arranged on the bobbin carrier tubes 16 on both sides are mounting devices 14 on to which bobbins 4 can be fitted. In that arrangement for example the bobbin row A through F is expanded by a further row G through M. It will be seen in that connection that the fitting pattern on the left-hand side 28 is not identical to that on the right-hand side 29. However the signal elements 17 or the display panel 25 give the operator the correct fitting pattern, depending on whether operation is begun on side 28 or on side 29 with the bobbin row A.

Besides bobbin creels with fixedly integrated bobbin carrier tubes, use is increasingly made nowadays of bobbin creels with bobbin carriages 30, as shown in FIG. 6. The advantage of the bobbin carriages is that the reserve carriages for a fresh batch can already be loaded while a winding operation is going on. FIG. 6 illustrates a bobbin creel carriage 31 comprising the individual bobbin carriages 30*a*, 30*b* and 30*c*. Identification of a given fitting pattern, in accordance with the invention, can be effected in absolutely identical fashion with the bobbin creel carriages, as with the fixedly installed bobbin creels. If need be certain plug contacts are to be provided for control connecting lines. The reserve bobbin carriages 32*a*, 32*b* and 32*c* are disposed outside the bobbin carriage creel 31, at a loading station (see FIG. 7). In the present example it is assumed that the reserve bobbin carriage 32*a* has already been loaded with full bobbins and is prepared as bobbin carriage No. 1 for being subsequently pushed into the bobbin carriage creel 31.

The situation is different with the second bobbin creel carriage 32*b* which is connected to the computer 21 of the warping machine 2, at the loading station 33, by way of a connecting line 34. The appropriate indications can also be provided on the display panel 24, in which respect it is additionally necessary in this case to specify the reserve bobbin carriages. The reserve bobbin carriage 32*c* is not yet at the loading station 33 and does not yet have any bobbins.

FIG. 8 shows a loading station in which the loading operation is not performed manually but with an automatic loading apparatus or with a robot 35. The latter also receives its orders by way of the connecting line 34 from the computer 21 of the warping machine. The signal elements 17 and the acknowledgement keys or buttons 18 can be totally omitted in a robot arrangement. The robot 35 is presented with a pallet 36 with the corresponding bobbin colour, while the corresponding bobbin colour can also be displayed on a display panel 25 for instructing the operator. The heavy work of fitting the bobbin into position is thus entirely eliminated so that the operator can in the meantime turn to other operations to be carried out.

FIG. 9 shows a further option in regard to identification of individual fitting patterns, without in that respect a signal element 17 having to be associated with each mounting device. For that purpose, arranged on both sides of the loading station is a positioning unit 38 provided with a movable light source 37. The positioning unit receives signals from the computer 21 by way of the connecting line 34 and controls the light source 37 in such a way that the light beam 39 thereof falls on to a given mounting device 40 which must be loaded with a given kind of bobbin. The display is again provided in combination with a working instruction on the display panel 25.

It will be seen that quite different means can be used for the identification of individual fitting patterns. In order to increase the degree of automation, for example the acknowledgement keys or buttons could also be replaced by automatic sensor devices in which acknowledgement of the mounting operation is effected automatically. It would be possible for example to envisage a sensor device which responds to the weight of the full bobbin. An electromagnetic, optical or mechanical sensing arrangement would also be possible.

It will be appreciated that a plurality of bobbin creels or loading stations can be actuated simultaneously with one control means. The control means or the computer may also be used for further monitoring and control functions which are not directly related to the loading operation, thus for example supervising the yarn monitors etc.

Identification of the mounting devices in accordance with the invention is also particularly advantageous in all the special cases in which for example the repeat exceeds the maximum number of bobbins at the creel. The missing bobbins must be fitted in relation to the next ribbon or sheet, while the control means automatically computes and displays that particular loading operation, on the basis of the warping data. That also applies in regard to the situation where special yarn qualities must be used at the outward sides of a warp.

The control means or the computer may also be programmed, in relation to two or multi-creel systems with carriage creels, in such a way that optimum operating procedures are always guaranteed by virtue of the identified fitting patterns. Instead of the optical displays being arranged separately beside the mounting devices, they could for example also be directly integrated into the mounting spindles.

We claim:

1. A method of loading a bobbin creel (3) of a warping installation having a plurality of mounting devices (14) for supporting bobbins (4) of different kinds comprising steps of determining an overall fitting pattern for an arrangement of the bobbins at the bobbin creel on a basis of a desired repeat pattern in a yarn array (10) to be wound, storing the fitting pattern in a control means (21) forming output signals for sequentially identifying, fitting patterns of bobbins of each said different kind, and loading the bobbin creel with all bobbins of the different kind, during a respective signal sequence and repeating the preceding two steps until all signal sequences have taken place and all the different kinds of bobbins are arranged in the fitting pattern.

2. A method as set forth in claim 1 further comprising using the output signals to activate an optical display identifying the fitting patterns for facillitating manual loading of the bobbins.

3. A method as set forth in claim 1 or claim 2, further comprising monitoring for the presence of bobbins at each mounting device (14) and triggering a further signal sequence only when all bobbins of each said different kind have been fitted in position in accordance with the fitting pattern specific to that kind.

4. A method as set forth in claim 1, further comprising using the output signals to actuate an automatic fitting apparatus for automatically fitting the bobbins in position.

5. A method as set forth in claim 1, wherein the output signals for different fitting patterns are selectively formed by the control means for the same repeat pattern at the yarn array.

6. An apparatus for loading a bobbin creel (3) of a winding installation, in particular a warping installation having a plurality of mounting devices (14) for supporting bobbins (4) of different kinds, comprising a control means (21) for storing data identifying a fitting pattern at the bobbin creel (3), and for generating output signals for each individual fitting pattern of a given kind of bobbin sequentially called up by the storage means, and means for identifying the mounting devices of the fitting pattern of each kind of bobbin, said identifying means being actuable by the control means.

7. An apparatus as set forth in claim 6, wherein the identifying means comprise an optical display associated with each mounting device.

8. An apparatus as set forth in claim 7 wherein the optical display is a light emitting diode display.

9. An apparatus as set forth in claim 7 or claim 8, further comprising a multiplexer for actuating the optical display of a bobbin row on the bobbin creel.

10. An apparatus as set forth in claim 7, further comprising an acknowledgement switch associated with each optical display, for enabling one to acknowledge that the mounting device has been loaded.

11. An apparatus as set forth in claim 10 wherein each acknowledgement switch is connected to the control means in such a way that a subsequent signal sequence can be triggered off only when all said displayed mounting devices of the fitting pattern are loaded with bobbins.

12. An apparatus as set forth in claim 7, wherein each mounting device has a sensor for monitoring for the presence of a bobbin.

13. An apparatus as set forth in claim 12, wherein each sensor is connected to the control means in such a way that a subsequent signal sequence can be triggered off only when all said displayed mounting devices of the fitting pattern are loaded with bobbins.

14. An apparatus as set forth in claim 6, wherein the identifying means further comprise an automatic fitting apparatus for automatically loading the mounting devices.

15. An apparatus as set froth in claim 6, wherein the identifying means further comprise a positioning unit including a light source arranged at a spacing relative to the bobbin creel for identifying the mounting devices by a light beam.

16. An apparatus as set forth in claim 6, wherein the control means comprises a computer for computing fitting patterns on the basis of inputted winding data.

17. An apparatus as set forth in claim 6, wherein the control means is connected to a display panel for displacing the respectively activated signal sequence.

* * * * *